US006251052B1

(12) United States Patent
Simonson

(10) Patent No.: US 6,251,052 B1
(45) Date of Patent: Jun. 26, 2001

(54) SQUAT EXERCISE APPARATUS

(75) Inventor: Roy Simonson, Colorado Springs, CO (US)

(73) Assignee: The Simonson Family Limited Partnership, Colorado Springs, CO (US)

( * ) Notice: Subject to any disclaimer, the term of this patent is extended or adjusted under 35 U.S.C. 154(b) by 0 days.

(21) Appl. No.: 09/395,193

(22) Filed: Sep. 14, 1999

(51) Int. Cl.[7] ..... A63B 21/062; A63B 23/04
(52) U.S. Cl. ..... 482/100; 482/137; 482/908
(58) Field of Search ..... 482/97, 100, 136–138, 482/145, 908, 144

(56) References Cited

U.S. PATENT DOCUMENTS 3,953,025 * 4/1976 Mazman ..... 482/118
4,357,011 * 11/1982 Voris ..... 482/139
4,549,734 * 10/1985 Hibler et al. ..... 482/135
5,102,121 * 4/1992 Solow et al. ..... 482/137
5,362,290 * 11/1994 Huang ..... 482/100
5,378,216 * 1/1995 Ish, III et al. ..... 482/94
5,419,751 * 5/1995 Byrd et al. ..... 482/138
5,447,480 * 9/1995 Fulks ..... 482/100
5,626,548 * 5/1997 Coyle ..... 482/137
5,904,638 * 5/1999 Habing et al. ..... 482/57
6,090,020 * 7/2000 Webber ..... 482/100

* cited by examiner

*Primary Examiner*—Glenn E. Richman
*Assistant Examiner*—Victor K. Hwang
(74) *Attorney, Agent, or Firm*—Hoffman, Wasson & Gitler

(57) ABSTRACT

An exercise apparatus for performing squat type exercises is disclosed. The apparatus includes a base supporting a resistance assembly and a pivoting user engaging assembly. A cable assembly links the user engaging assembly to the resistance assembly for applying resistance as a user performs an exercising routine. The user engaging assembly includes an upwardly extending post and a pivot arm secured to a free end of the upwardly extending post. The user engaging assembly further includes a locking assembly integrally associated with the pivot arm assembly for controlling the pivotal movement of the pivot arm.

17 Claims, 4 Drawing Sheets

SQUAT EXERCISE APPARATUS

BACKGROUND OF THE INVENTION

1. Field of the Invention

The invention relates to exercise apparatuses. More particularly, the invention relates to an exercise apparatus designed for performing squats in a convenient, safe and effective manner.

2. Description of the Prior Art

The squat is a free-weight exercise in which a barbell is placed on a user's shoulders directly behind the neck and is supported by the arms while the user first lowers his or her body by bending the legs and then raises his or her body by restraightening the legs. This exercise is probably the most effective exercise for building lower body muscles and often is used by experienced weight lifters.

However, this exercise can be one of the most painful and traumatic exercises since the legs are capable of lifting a large amount of weight and yet the weight must be supported by the lifter's arms and shoulders. In addition, it is one of the most dangerous exercises since it typically is terminated by placing the barbell on a rack when the lifter's legs are fully extended. As the lifter approaches his or her limit, it becomes difficult to obtain this position. Furthermore, the weight tends to throw lifters forward and cause them to lose their balance. It is, therefore, usually necessary to have two spotters when performing the squat.

With the foregoing in mind, a variety of prior art squat type exercise apparatuses have been developed to provide a safer environment for performing squats. Most of these apparatuses require that an individual partially squat into position such that his or her back and/or shoulders engage a user support member coupled to a source of resistance. Once the user is properly positioned relative to the user support member, he or she may move through an exercise routine. The user then moves from the user support member and steps away from the exercise apparatuses.

Considering these simple steps, the prior art is surprisingly filled with squat type exercise apparatuses which are difficult to use. For example, many squat type exercise apparatuses require users of different sizes to adapt to the apparatus itself rather than readily adjust for different size users. Where the squat type exercise apparatus does provide a mechanism for adjusting to suit users of differing sizes, prior art mechanisms are invariably difficult to use. While prior art squat type exercise apparatuses offer many set up challenges for users wishing to take advantages of the apparatuses, these prior art squat type exercise apparatuses are even more difficult to get out of once a user's exercise routine is completed.

With this in mind, the inventor has studied the prior squat type exercise apparatuses and determined that a need overwhelmingly exists for a squat type exercise apparatus offering users a convenient, adaptable and easy to use apparatus for performing squat type exercises. The inventor has, therefore, developed the present exercise apparatus overcoming the shortcomings of prior art devices.

SUMMARY OF THE INVENTION

It is, therefore, an object of the present invention to provide an exercise apparatus for performing squat type exercises. The apparatus includes a base supporting a resistance assembly and a pivoting user engaging assembly. A cable assembly links the user engaging assembly to the resistance assembly for applying resistance as a user performs an exercising routine. The user engaging assembly includes an upwardly extending post and a pivot arm secured to a free end of the upwardly extending post. The user engaging assembly further includes a locking assembly integrally associated with the pivot arm assembly for controlling the pivotal movement of the pivot arm.

It is also an object of the present invention to provide an exercise apparatus wherein the locking assembly includes a ratchet arm pivotally secured to the upwardly extending post adjacent a pivot point for the pivot arm such that the ratchet arm moves with the pivot arm as a user moves up and down.

It is a further object of the present invention to provide an exercise apparatus wherein the ratchet arm further includes an arcuate latching bar with a series of holes shaped and dimensioned for engagement with a locking pin coupled to the pivot arm at a central location thereof such that the locking arm is controlled for selective engagement with the latching bar holes to orient the pivot arm at a desired position relative the ratchet arm.

It is another object of the present invention to provide an exercise apparatus wherein the locking pin is spring bias for selective engagement and release of the latching bar holes.

It is also an object of the present invention to provide an exercise apparatus wherein the locking pin is controlled by a release handle.

It is a further object of the present invention to provide an exercise apparatus wherein a cable links the locking pin to the release handle in a manner allowing the release handle to control the movement of the locking pin.

It is another object of the present invention to provide an exercise apparatus wherein a back/shoulder engaging assembly is secured to an end of the pivot arm and the release handle is coupled to the back/shoulder engaging assembly.

It is also an object of the present invention to provide an exercise apparatus wherein the cable assembly consists essentially of a single cable linked between the resistance assembly and the user engaging assembly.

It is a further object of the present invention to provide an exercise apparatus wherein the base includes a user support platform upon which a user may stand while performing exercises It is another object of the present invention to provide an exercise apparatus wherein the user support platform includes a first end and a second end adjacent the user engaging assembly, and the user support platform is inclined upwardly as it extends from a central section of the user support platform toward the first end of the user support platform.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
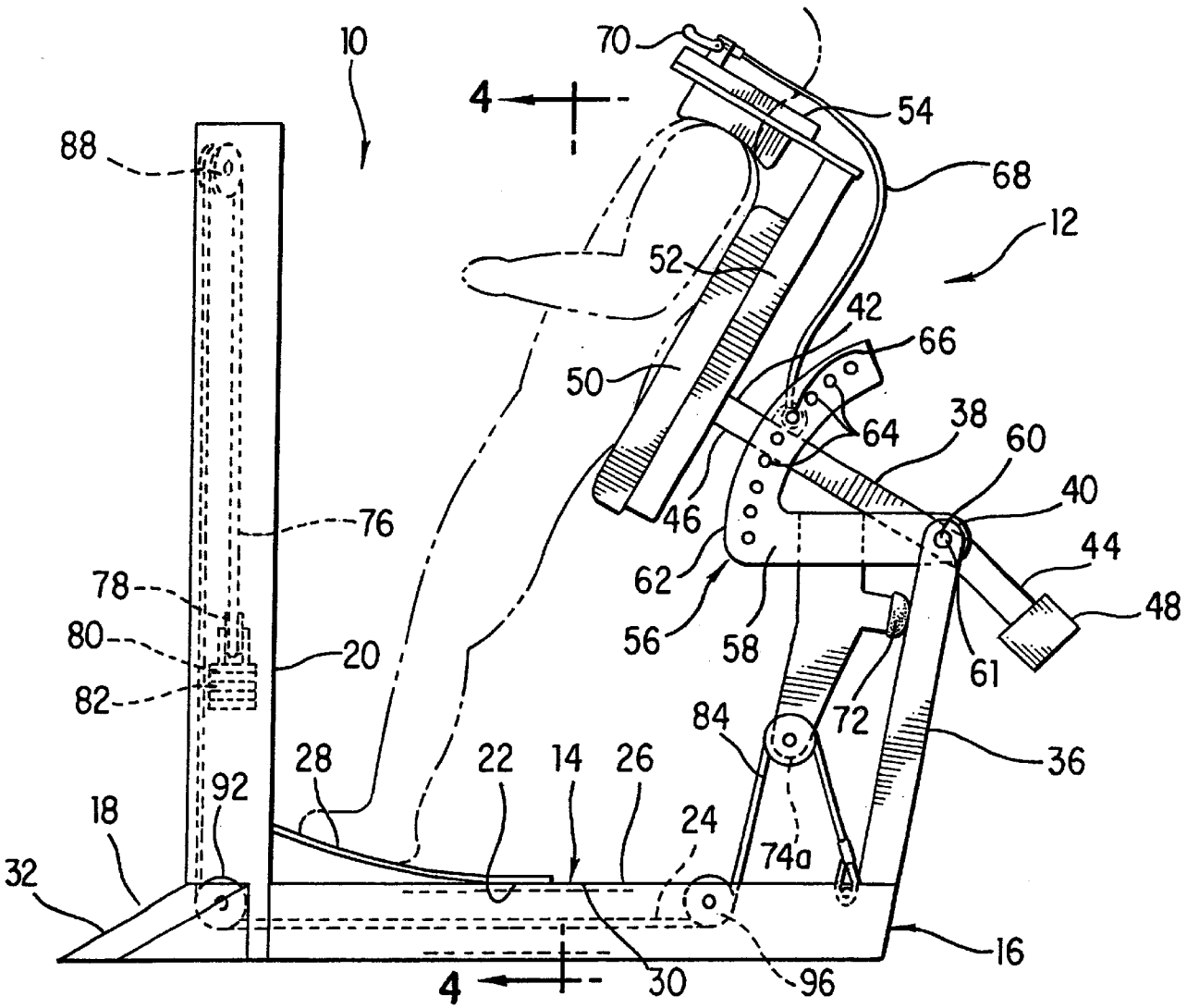
FIG. 1 is a side view of the exercise apparatus in accordance with the present invention showing the user in the entry, or exit, position.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1 to 6, a squat exercise apparatus 10 is disclosed. The squat exercise apparatus 10 is designed for permitting a user to quickly and conveniently enter the machine, adjust the user engaging member 12 to fit the user and effectively perform squat exercises working the muscles of a user's legs and back. The apparatus design and movement patterns mimic a free weight squat by allowing the user to freely choose the range of motion and start position with body angles replicating the free weight version of the exercise. The finishing position also replicates the free weight version of a squat with the body and legs in a straight line.

The squat exercise apparatus 10 includes a central support member 14 having a free first end 16 and a second end 18 to which a weight stack 20 is secured. The central support member 14 is preferably rectangular in cross section and includes a central passageway 22 extending from the first end 16 to the second end 18. The passageway 22 provides for the passage of a cable 24 therethrough in a manner which will be described in greater detail below. As with the other structural components of the present invention, the central support member 14 is formed from steel, although other materials may be used without departing from the spirit of the present invention.

Between the first end 16 and the second end 18 of the central support member 14, the central support member 14 includes a platform 26 sized, shaped and constructed to support a standing user while he or she operates the present squat exercise apparatus 10. For reasons which will be better appreciated based upon the following disclosure, the forward portion 28 of the platform 26 curves upwardly as it extends from the central portion 30 of the platform 26 toward the second end 18 of the central support member 14. The curved foot platform 28 allows an individual to position his or her feet so as to not over or under extend the ankle when achieving the desired foot placement relative to the torso.

First and second lateral support members 32, 34 add additional stability to the present squat exercise apparatus 10. The lateral support members 32, 34 extend outwardly and rearwardly from the central support member 14 to create a stable tripod base for the present squat exercise apparatus 10.

A user engaging member 12 is coupled to the central support member 14 adjacent its first end 16. The user engaging member 12 is designed to physically engage the back and shoulders of a user in a manner permitting the user to repetitively bend his or her knees in a conventional squatting motion. The user engaging member 12 is readily adjustable to accommodate users of various sizes. The user engaging member 12 also allows for simple entry and exit from the squat exercise apparatus 10.

Specifically, and with reference to FIGS. 1, 2, 3 and 5, an upwardly extending support post 36 pivotally supports a pivoting user engaging assembly 38. The orientation of the support post 36, in combination with the pivoting user engaging assembly 38 define the up and down motion of the present apparatus 10 to permit the squat motion discussed above. The upwardly extending support post 36 extends upwardly from the first end 16 of the central support member 14 at an angle and for a distance.

The pivoting user engaging assembly 38 is pivotally secured to the free end 40 of the upwardly extending support post 36. The pivoting user engaging assembly 38 includes a pivot arm 42 directly attached to the upwardly extending support post 36. The pivot arm 42 includes a first end 44 and a second end 46,and is pivotally secured to the upwardly extending support post 36 at a position adjacent the first end 44 thereof. A counterweight 48 is coupled to the first end 44 of the pivot arm 42 at a position on the other side of the upwardly extending support post 36 relative to the second end 46 of the pivot arm 42. The counterweight 48 acts to reduce the effects of momentum and ensure that the user is only lifting the weight imparted by the weight stack 20 itself.

A back/shoulder engaging member 50 is coupled to the second end 46 of the pivot arm 42. As will be discussed in greater detail below, the back/shoulder engaging member 50 is oriented to permit ready access by an individual wishing to use the present squat exercise apparatus 10. Briefly, the back/shoulder engaging member 50 includes a back support member 52 coupled to a shoulder support member 54 such that the shoulder support member 54 is oriented perpendicular to the back support member 52. Both the back support member 52 and the shoulder support member 54 are padded to enhance user comfort while exercising. This structure creates a framework allowing a user's back to engage the back support member 52, while the user's shoulders engage the shoulder support member 54, to push the back/shoulder engaging member 50 upwardly under the force of the user's legs.

Pivotal movement of the pivoting user engaging assembly 38 is controlled by a locking assembly 56 integrally associated with the pivot arm 42 and the back/shoulder engaging member 50. The locking assembly 56 includes a ratchet arm 58 pivotally secured to the upwardly extending support post 36 adjacent the pivot point 60 for the pivot arm 42. In fact, the pivot point 60 for the pivot arm 42 is aligned with the pivot point 61for the ratchet arm 58. In this way, and as will be discussed below in greater detail, the ratchet arm 58 pivots with the pivot arm 42 as a user moves up and down.

The ratchet arm 58 includes an arcuate latching bar 62 located at its free end. The arcuate latching bar 62 is shaped for alignment with the arcuate path of the pivot arm 42 as it moves about its pivot point 60. The latching bar 62 includes a series of holes 64 shaped and dimensioned for engagement with a locking pin 66 coupled to the pivot arm 42 at a central location thereof (see FIG. 6). In this way, the locking pin 66 is controlled for selective engagement with the latching bar holes 64 to lock the pivot arm 42 at a desired position relative the ratchet arm 58. The pivot arm 42 may be readily locked at relative positions to define the range of motion offered by the exercise apparatus 10. The selective locking of the pivot arm 42 relative to the ratchet arm 58 also facilitates simple ingress and egress from the exercise apparatus 10.

Figure 6:
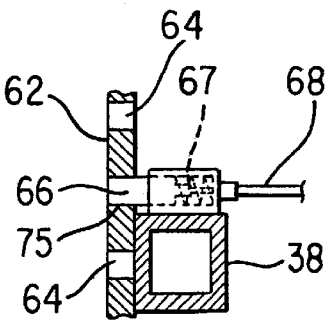
FIG. 6 is a cross sectional view along the line 6—6 in FIG. 3.

As will be discussed below with reference to the use of the present squat exercise apparatus 10, and with reference to FIGS. 5 and 6, the locking pin 66 is spring 67 biased for selective engagement and release of the latching bar holes 64. Control of the locking pin 66 is effected by a locking pin cable 68. The locking pin cable 68 controls the movement of the locking pin 66. The locking pin cable 68 couples the locking pin 66 with a release handle 70 conveniently positioned on the shoulder support member 54. Actuation of the release handle 70 pulls the locking pin cable 68 to pull the locking pin 66 inwardly against the spring bias and thereby release the locking pin 66 from whichever latching bar hole 64 the pin is presently positioned within. While the release handle 70 is coupled to the shoulder support member 54 in accordance with the preferred embodiment of the present invention, the release handle 70 may be positioned at other locations without departing from the spirit of the present invention.

The pivoting user engagement assembly 38, and particularly the ratchet arm 58, include a rearwardly oriented bumper member 72 positioned to engage the upwardly extending support post 36. The bumper member 72 limits the pivotal motion of the pivoting user engagement assembly 38, and specifically, the locking assembly 56. In this way, the rearward motion of the locking assembly 56 is controlled while the pivot arm 42 ratchets downwardly during the initial adjustment of the apparatus 10 as will be discussed below in greater detail.

Referring to FIGS. 1, 2, 3 and 5, the pivoting user engagement assembly 38 also includes a pair of downwardly oriented pulleys 74 position on opposite sides of the ratchet arm 58. The function of these pulleys will be discussed below as the use of the present squat exercise apparatus is disclosed in detail.

Figure 2:
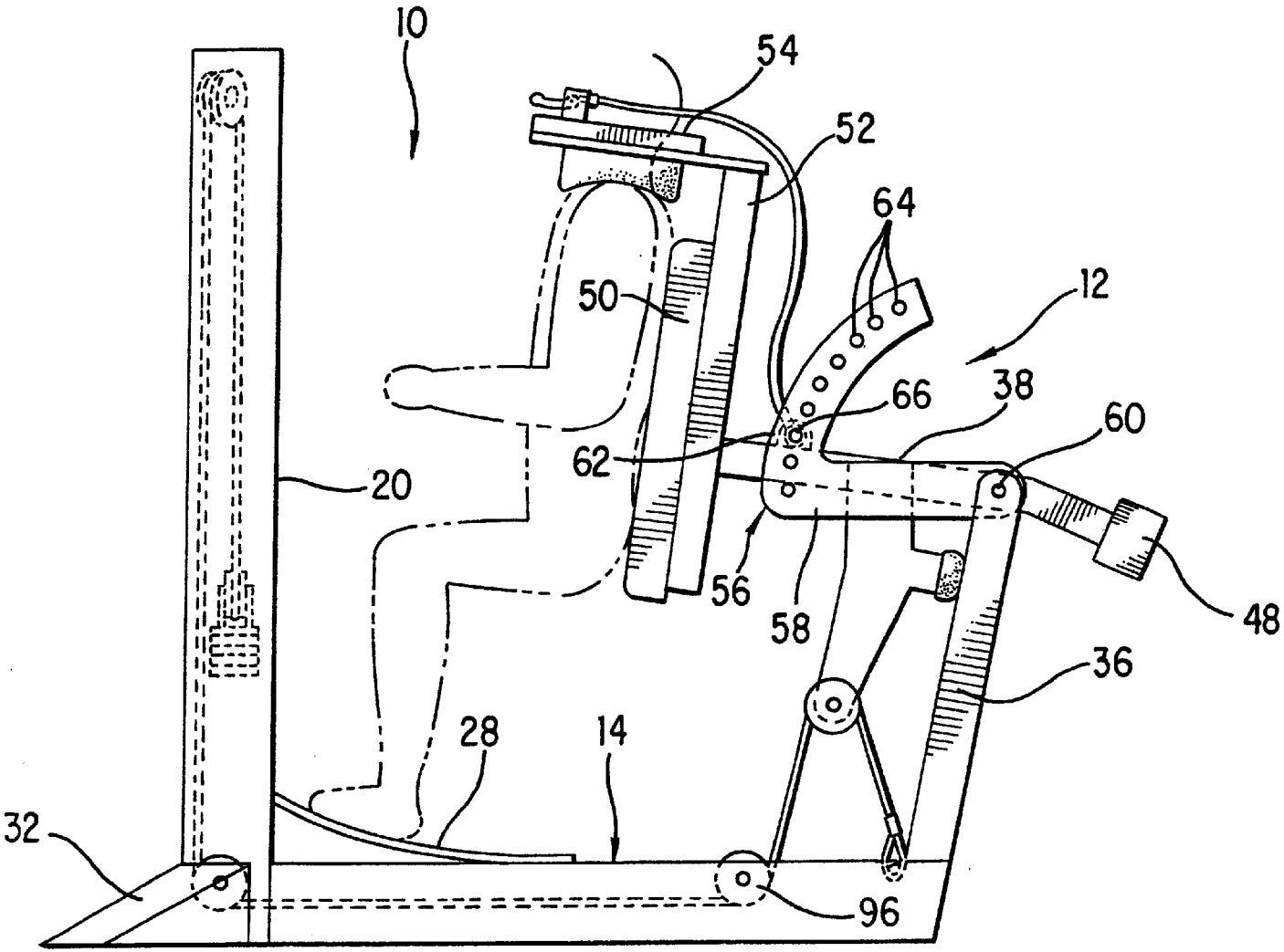
FIG. 2 is a side view of the exercise apparatus shown in FIG. 1 with the user in the initial set up position.
Figure 3:
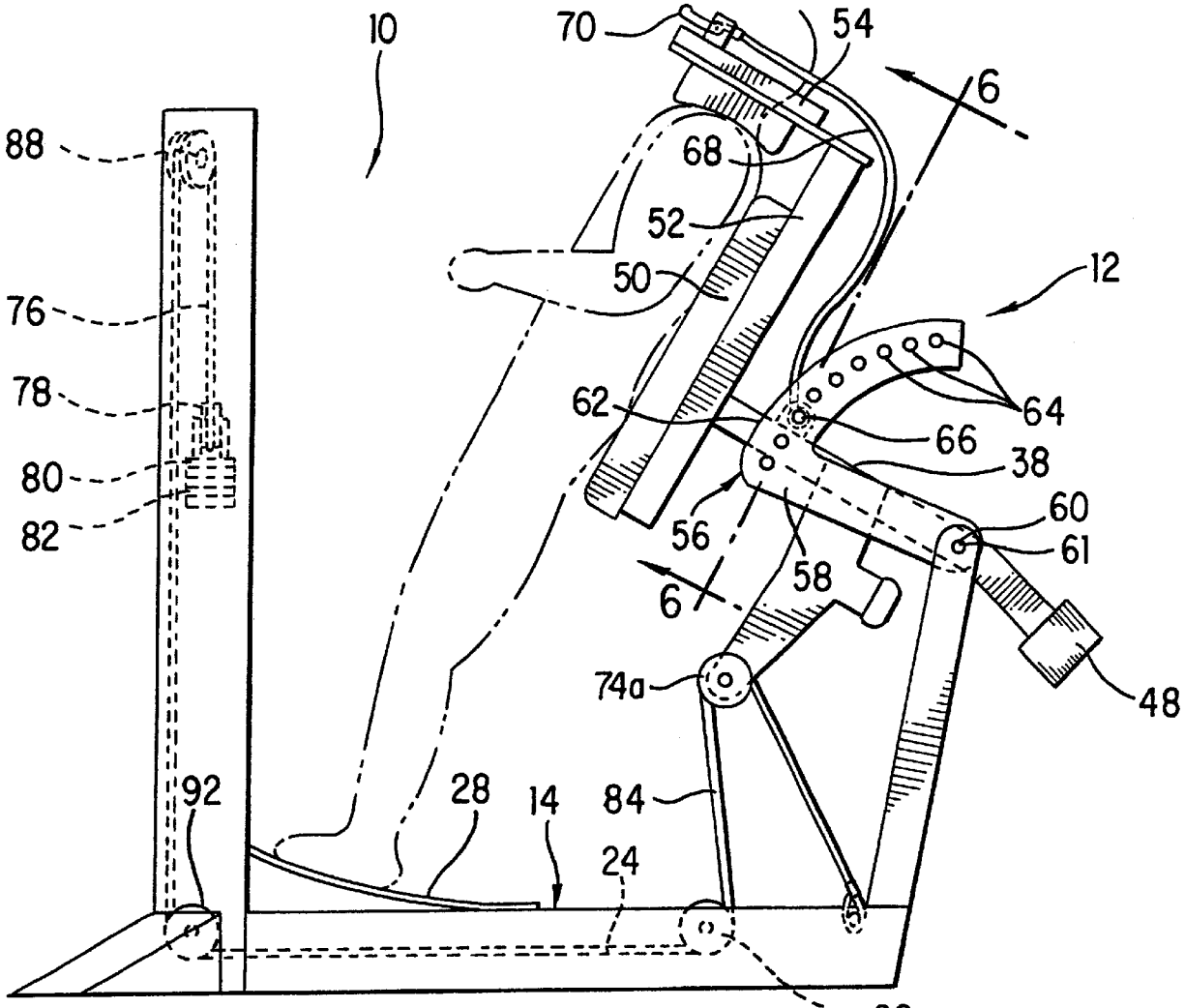
FIG. 3 is a side view of the exercise apparatus shown in FIG. 1 with the user in an extended position during his or her exercise routine.

With reference to FIGS. 1, 2 and 3, the use of the squat exercise apparatus 10 will now be described in detail. A user first steps upon the platform 26 and moves under the pivoting user engaging assembly 38 (see FIG. 1). Once the user is properly positioned beneath the pivoting user engaging assembly 38, he or she may position his or her foot upon the upwardly curved portion 28 of the platform 26 until he or she is comfortably leaning against the back support member 52 of the pivoting user engaging assembly 38.

At this time, the user begins the initial squat by moving downwardly (see FIG. 2). With reference to FIG. 6, the locking pin 66 is provided with an angled face 75 allowing the user to move the pivoting user engaging assembly 38 downwardly as the angled face 75 of the locking pin 66 ratchets through the latching bar holes 64 until the user stops at his or her chosen start position. The bumper member 72 limits rearward motion of the locking assembly 56 permitting the pivot arm 42 to move relative the ratchet arm 58 for orienting the pivot arm 42 at a desired start position. As the user begins to rise, the locking pin snaps into a specific latching bar hole 64 to complete the engagement process.

Once the locking pin 66 properly seats within a desired latching bar hole 64, the pivot arm 42 is linked to the weight stack 20 via the ratchet arm 58 and the cable 24. The user then moves through his or her exercise routine as shown in FIG. 3. As discussed above, movement of the pivoting user engaging assembly 38 works against the resistance provided by weight stack 20.

Figure 5:
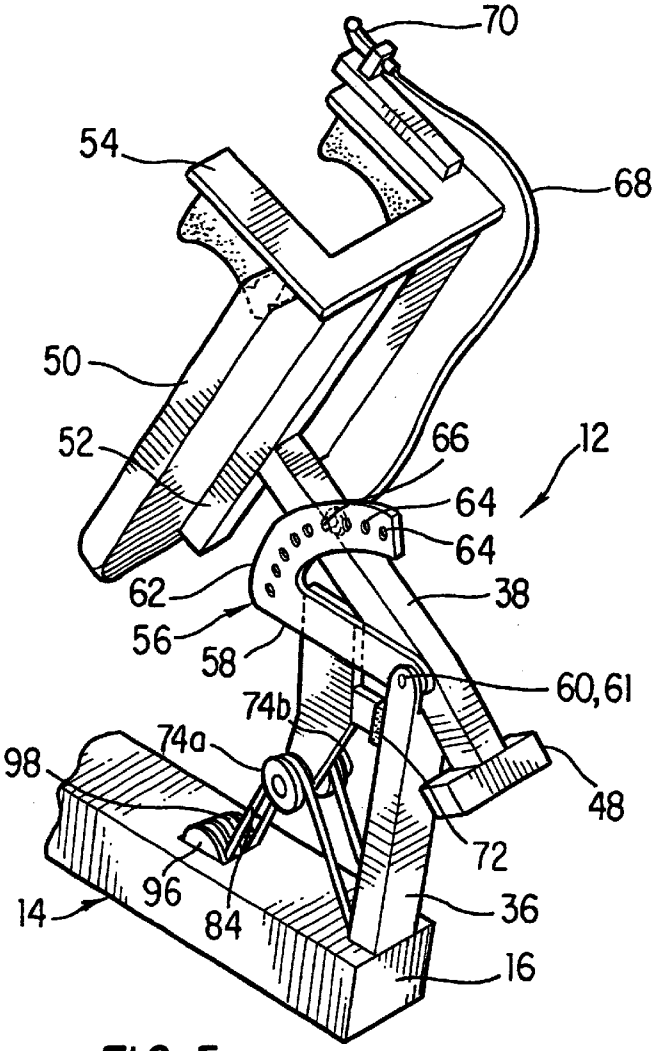
FIG. 5 is a perspective view from the rear of the exercise apparatus shown in FIG. 1.
Figure 4:
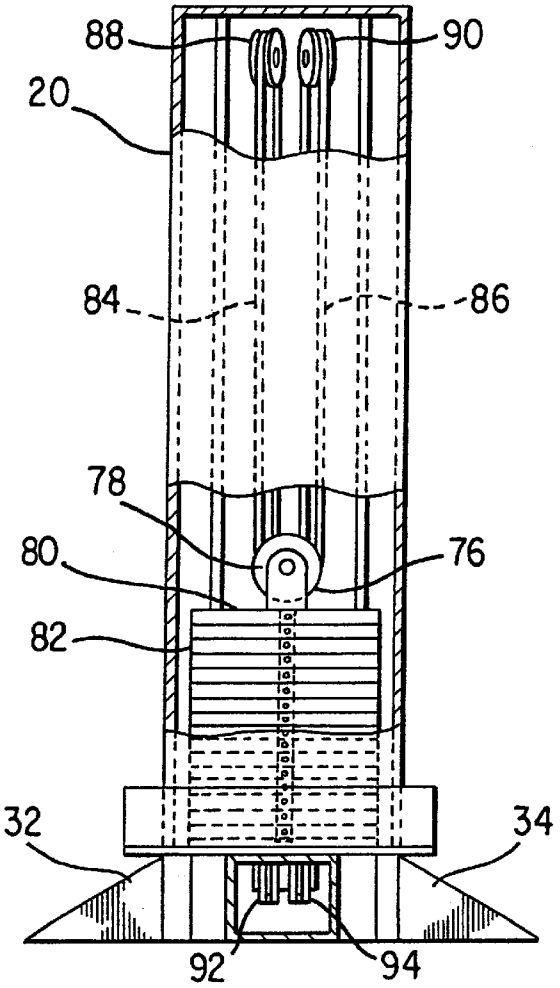
FIG. 4 is a cross sectional view along the line 4—4 in FIG. 1 showing the weight stack in partial cross section.

With reference to FIGS. 3, 4 and 5, a single cable 24 links the pivoting user engaging assembly 38 to the weight stack 20 for lifting the stack of weight plates 82. The cable 24 is run through a series of pulleys to facilitate the application of a resistant force as the pivoting user engaging assembly 38 is moved by the user. Specifically, the central portion 76 of the cable 24 is passed through a first pulley 78. A coupling member 80 directly couples the stack of weight plates 82 to the first pulley 78 in a conventional manner. Opposite first and second strands 84, 86 of the cable 24 then respectively extend over first and second upper pulleys 88, 90 before passing over first and second lower pulleys 92, 94.

After passing over the first and second lower pulleys 92, 94, the respective first and second strands 84, 86 of the cable 24 pass through the passageway formed in the central support member 14 and toward the first end of the central support member 14. The first and second strands 84, 86 exit the central support member 14 under the control of first and second control pulleys 96, 98 at a position slightly before the first end 16 of the central support member 14, pass over the downwardly oriented pulleys 74*a*, 74*b* of the pivoting user engaging assembly 38 and are securely attached to the base of the upwardly extending support post 36. In this way, pivotal movement of the user engaging member 12 draws and releases the cable 24 in a manner lifting the stack of weight plates 82.

Once the user has completed his or her routine, the user presses the release handle 70 to disengage the locking pin 66 from the latching bar hole 64, stands up and steps away from the squat exercise apparatus 10 (see FIG. 1).

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. An exercise apparatus for performing squat type exercises, comprising:

a base supporting a resistance assembly and a pivoting user engaging assembly, wherein a cable assembly links the user engaging assembly to the resistance assembly for applying resistance as a user performs an exercising routine;

the user engaging assembly includes an upwardly extending post and a pivot arm secured to a free end of the upwardly extending post; and wherein the user engaging assembly further includes a locking assembly integrally associated with the user engaging assembly for controlling the pivotal movement of the pivot arm wherein the locking assembly includes a ratchet arm pivotally secured to the upwardly extending post adjacent a pivot point for the pivot arm such that the ratchet arm moves with the pivot arm as a user moves up and down, the ratchet arm interacting with a locking pin shaped and dimensioned for ratcheting relative the pivot arm to permit free relative movement in one direction as a user moves to a starting position and subsequently locking into position as the user moves in an opposite direction to begin an exercise routine.

2. The exercise apparatus according to claim 1, wherein the ratchet arm further includes an arcuate latching bar with a series of holes shaped and dimensioned for engagement with the locking pin coupled to the pivot arm at a central location thereof such that the locking pin is controlled for selective engagement with the latching bar holes to orient the pivot arm at a desired position relative the ratchet arm.

3. The exercise apparatus according to claim 2, wherein the locking pin is spring biased for selective engagement and release of the latching bar holes.

4. The exercise apparatus according to claim 3, wherein the locking pin is controlled by a release handle.

5. The exercise apparatus according to claim 4, wherein a cable links the locking pin to the release handle in a manner allowing the release handle to control the movement of the locking pin.

6. The exercise apparatus according to claim 4, wherein a back/shoulder engaging assembly is secured to an end of the pivot arm and the release handle is coupled to the back/shoulder engaging assembly.

7. The exercise apparatus according to claim 1, wherein the cable assembly consists essentially of a single cable linked between the resistance assembly and the user engaging assembly.

8. The exercise apparatus according to claim 1, wherein the base includes a user support platform upon which a user may stand while performing exercises.

9. The exercise apparatus according to claim 8, wherein the user support platform includes a first end and a second end adjacent the user engaging assembly, and the user support platform is inclined upwardly as it extends from a central section of the user support platform toward the first end of the user support platform.

10. An exercise apparatus, comprising:

a base supporting a resistance assembly and pivoting user engaging assembly, wherein a cable assembly links the user engaging assembly to the resistance assembly for applying resistance as a user performs an exercising routine;

the user engaging assembly includes an upwardly extending post and a pivot arm secured to a free end of the upwardly extending post;

the user engaging assembly further includes a locking assembly integrally associated with the user engaging assembly for controlling the pivotal movement of the pivot arm, the locking assembly includes a ratchet arm pivotally secured to the upwardly extending post adjacent a pivot point for the pivot arm such that the ratchet arm moves with the pivot arm as a user moves up and down, the ratchet arm further includes an arcuate latching bar with a series of holes shaped and dimensioned for engagement with a locking pin coupled to the pivot arm at a central location thereof, the locking pin being shaped and dimensioned to permit free relative movement in one direction as the locking pin ratchets relative the pivot arm for selective engagement with the latching bar holes to orient the pivot arm at a desired position relative the ratchet arm.

11. The exercise apparatus according to claim 10, wherein the locking pin is spring biased for selective engagement and release of the latching bar holes.

12. The exercise apparatus according to claim 11, wherein the locking pin is controlled by a release handle.

13. The exercise apparatus according to claim 12, wherein a cable links the locking pin to the release handle in a manner allowing the release handle to control the movement of the locking pin.

14. The exercise apparatus according to claim 12, wherein a back/shoulder engaging assembly is secured to an end of the pivot arm and the release handle is coupled to the back/shoulder engaging assembly.

15. The exercise apparatus according to claim 10, wherein the cable assembly consists essentially of a single cable linked between the weight stack and the user engaging assembly.

16. The exercise apparatus according to claim 10, wherein the base includes a user support platform upon which a user may stand while performing exercises.

17. The exercise apparatus according to claim 16, wherein the user support platform includes a first end and a second end adjacent the user engaging assembly, and the user support platform is inclined upwardly as it extends from a central section of the user support platform toward the first end of the user support platform.

* * * * *

UNITED STATES PATENT AND TRADEMARK OFFICE

CERTIFICATE OF CORRECTION

PATENT NO. : 6,251,052 B1
DATED : June 26, 2001
INVENTOR(S) : Roy Simonson

It is certified that error appears in the above-identified patent and that said Letters Patent is hereby corrected as shown below:

Column 4,
Line 15, change “46,and” to -- 46, and --
Line 46, change “61for” to -- 61 for --
Line 67, change “is” to -- has a --

Column 5,
Line 17, change “include” to -- includes --
Line 28, change “position” to -- positioned --
Line 50, after “relative”, insert -- to --

Column 6,
Line 15, after “38”, insert a comma

Signed and Sealed this

Eighteenth Day of June, 2002

*Attest:*

*Attesting Officer*

JAMES E. ROGAN
*Director of the United States Patent and Trademark Office*